US006623201B2

(12) United States Patent
Brumlik

(10) Patent No.: US 6,623,201 B2
(45) Date of Patent: Sep. 23, 2003

(54) CLEANING DEVICE AND METHOD OF USE

(76) Inventor: John Francois Brumlik, 2312 The Strand, Manhattan Beach, CA (US) 90266

( * ) Notice: Subject to any disclaimer, the term of this patent is extended or adjusted under 35 U.S.C. 154(b) by 167 days.

(21) Appl. No.: 09/745,146

(22) Filed: Dec. 20, 2000

(65) Prior Publication Data

US 2001/0052353 A1 Dec. 20, 2001

Related U.S. Application Data

(60) Provisional application No. 60/172,260, filed on Mar. 19, 1999, and provisional application No. 60/231,217, filed on Sep. 8, 2000.

(51) Int. Cl.[7] ..... A46B 11/04

(52) U.S. Cl. ..... 401/279; 401/270; 401/276; 401/278; 401/282

(58) Field of Search ..... 401/270, 272, 401/273, 276, 278, 279, 194, 282, 289, 292, 192

(56) References Cited

U.S. PATENT DOCUMENTS

| | | | | |
|---|---|---|---|---|
| 371,899 A | | 10/1887 | Osborne | |
| 838,241 A | | 12/1906 | Conners | |
| 875,422 A | | 12/1907 | Garvey et al. | |
| 894,359 A | | 7/1908 | Anthony | |
| 1,099,209 A | | 6/1914 | Segal et al. | |
| 1,099,262 A | * | 6/1914 | Martin et al. | 401/276 |
| 1,142,911 A | * | 6/1915 | Riddiford | 401/289 |
| 1,548,259 A | * | 8/1925 | Erikson | 401/278 |
| 2,095,423 A | | 10/1937 | Tilley | |
| 2,496,181 A | * | 1/1950 | Stange | 401/279 |
| 2,509,568 A | | 5/1950 | Lachapelle | |
| 2,521,882 A | | 9/1950 | Swift et al. | |
| 2,726,417 A | | 12/1955 | Rowser et al. | |
| 2,779,963 A | * | 2/1957 | Wohl et al. | 401/278 |
| 2,920,333 A | | 1/1960 | Montague et al. | |
| 3,756,729 A | | 9/1973 | Tufts | |
| 3,837,751 A | | 9/1974 | Ross | |
| 4,008,968 A | | 2/1977 | Hobbs | |

(List continued on next page.)

FOREIGN PATENT DOCUMENTS

| | | | | |
|---|---|---|---|---|
| DE | 40 05 419 A1 | | 8/1991 | |
| EP | 0 005 685 | * | 4/1979 | 401/289 |
| FR | 929420 | | 12/1947 | |
| FR | 2 694 743 A1 | | 2/1994 | |

OTHER PUBLICATIONS

Soap Pump Palm Brush—Made in China—OXO and Good Grips are registered trademarks of OXO International, division of General Housewares Corp., Terre Haute IN.

International Search Report causing foreign patents to be listed.

*Primary Examiner*—David J. Walczak
(74) *Attorney, Agent, or Firm*—Knobbe, Martens, Olson & Bear LLP

(57) ABSTRACT

A cleaning device for cleaning toilets, bathroom fixtures, and other surfaces. The device encloses a reservoir contained in a hollow handle for storing a cleaning solution, with a cap connected to one end of the handle and a base connected to the other end of the handle. A brush, sponge or other scrubber or cleaning surface is preferably attached to the base. A manually operated flow control mechanism opens a valve which seals at least one exit or dispensing orifice at or near the base of the reservoir, and thereby allows volume of cleaning solution to be dispensed at a reasonably fast, controlled rate of flow. In one embodiment, manually operated vacuum pressure release orifices are located at the opposite end of the reservoir from the exit orifice and are normally closed, but may be opened to minimize or eliminate any vacuum (subatmospheric pressure) in the reservoir, thereby aiding the flow of liquid from the reservoir through the exit orifice.

28 Claims, 10 Drawing Sheets

U.S. PATENT DOCUMENTS

| | | | | | |
|---|---|---|---|---|---|
| 4,044,724 | A | | 8/1977 | Merchill | |
| 4,128,349 | A | | 12/1978 | Del Bon | |
| 4,143,982 | A | | 3/1979 | Cox et al. | |
| 4,176,980 | A | | 12/1979 | O'Neal et al. | |
| 4,229,116 | A | | 10/1980 | Moore | |
| 4,319,852 | A | | 3/1982 | Bell et al. | |
| 4,506,810 | A | | 3/1985 | Goncalves | |
| 4,747,720 | A | | 5/1988 | Bellehumeur et al. | |
| 4,810,124 | A | | 3/1989 | Krueckel et al. | |
| 4,826,340 | A | | 5/1989 | Rothweiler et al. | |
| 4,875,791 | A | | 10/1989 | Hassan | |
| 4,883,204 | A | | 11/1989 | Kay et al. | |
| 4,886,388 | A | | 12/1989 | Gulker et al. | |
| 4,893,957 | A | | 1/1990 | Byriel | |
| 4,984,923 | A | | 1/1991 | Ota | |
| 5,211,494 | A | | 5/1993 | Baijnath | |
| 5,297,882 | A | | 3/1994 | Kornides | |
| 5,397,194 | A | | 3/1995 | Yuan et al. | |
| 5,443,321 | A | | 8/1995 | Dolan et al. | |
| 5,454,659 | A | | 10/1995 | Vosbikian et al. | |
| 5,469,991 | A | | 11/1995 | Hamalainen | |
| 5,482,187 | A | | 1/1996 | Poulsen et al. | |
| 5,641,233 | A | | 6/1997 | Wilson | |
| 5,888,002 | A | | 3/1999 | Fenstersheib | |
| 5,931,596 | A | | 8/1999 | Javier | |
| 5,941,379 | A | | 8/1999 | Barardo | |
| 5,984,555 | A | * | 11/1999 | Samad | 401/176 |
| 6,056,470 | A | | 5/2000 | Nehashi et al. | |
| 6,068,422 | A | * | 5/2000 | Smith | 401/194 |
| 6,210,064 | B1 | * | 4/2001 | White et al. | 401/279 |
| 6,227,744 | B1 | | 5/2001 | Fodrocy et al. | |
| 6,302,607 | B1 | * | 10/2001 | Burrowes et al. | 401/183 |
| 6,364,557 | B1 | * | 4/2002 | Dougherty | 401/183 |

* cited by examiner

CLEANING DEVICE AND METHOD OF USE

CROSS-REFERENCE TO RELATED APPLICATIONS

This application claims the benefit of U.S. Provisional Application No. 60/172,260, filed Mar. 19, 1999, and U.S. Provisional Application No. 60/231,217, filed Sep. 8, 2000. The entirety of both of these applications are hereby incorporated by reference.

BACKGROUND OF THE INVENTION

1. Field of the Invention

This invention relates to a cleaning device which combines a scrubbing member with a handle and a reservoir for holding cleaning or disinfectant solution. More particularly, this invention relates to a method and apparatus for dispensing such solution at or near to the scrubber in a controlled manner.

2. Description of the Related Art

Cleaning toilets and other bathroom and household fixtures is an inherently dirty business, not only in terms of general cleanliness, but also because these areas are typically prone to growth of bacteria and other germs. In fact, bathrooms which remain uncleaned are widely recognized as significant contributors to the spread of disease. Typically, cleaning products for bathroom and other household fixtures are applied to fixture surfaces and then a brush or other medium is used to scrub the fixture and surrounding areas. Humans continue to clean toilets and other bathroom fixtures with only a common brush and separately contained and dispensed soap or disinfectant. Additionally, these separately contained disinfectants often use enviromnentally challenging aerosol sprays.

Hand held devices which couple a scrubbing surface with a dispensing reservoir have been proposed, such as in U.S. Pat. No. 1,099,209 to Segal et al.; U.S. Pat. No. 2,509,568 to Lachapelle; U.S. Pat. No. 2,726,417 to Rowser et al.; U.S. Pat. No. 2,920,333 to Montague et al.; U.S. Pat. No. 3,837,751 to Ross; and U.S. Pat. No. 4,826,340 to Rothweiler et al. While these types of devices offer some help for certain household cleaning chores, they are either inadequate for cleaning jobs which require significant release of soap or fluid due to undeveloped sealing mechanics, or they have limited ability to release continuous streams of soap or disinfectant.

For example, many of these prior devices employ a "squeezable" or "compressible" reservoir container. Compressible mechanisms of this type have several shortcomings for use as a bathroom or other household brush. For example, they require enough compressibility to ensure sufficient pressure is developed within the reservoir to overcome a seal and deliver cleansing liquid to the brush head. Moreover, these designs require a joint between a flexible material reservoir and a rigid material holding the brush head fibers or sponge. Given the force which is often exerted on bathroom brushes during use, the compressibility of these devices makes them less durable than is desired.

U.S. Pat. No. 5,211,494 to Baijnath proposes a skin stimulating brush which includes a container for retaining liquid soap, nipple means for releasing soap and an air vent. Both the nipple means and the air vent are positioned in the bottom of the container, and are opened and closed by sliding a plate between ON and OFF positions. The air vent is usually in contact with the fluid as the fluid is being released from the container through the nipple means, thereby significantly reducing the efficacy of the air vent and making the design generally insufficient for most household cleaning chores.

U.S. Pat. No. 4,883,204 to Kay et al. describes a device which is not used for cleaning, but rather is a fluid dispenser which is used for releasing cosmetics such as nail polish. A fluid discharge opening and a vent opening are provided at opposite ends of the device housing. However, as this particular design is envisioned for liquids prone to drying when in contact with air, such as nail polish, the fluid discharge opening seal must permit predetermined bleeding of fluid from the housing interior space through the discharge opening so as to facilitate prevention of brush or other applicator drying during periods of nonuse. This is unnecessary for a common cleaning brush such as a toilet brush, since the bristles are not prone to drying. In fact, it is actually counterproductive for cleaning devices since a common complaint of currently available dispensing cleaning brushes is that they leak.

Other designs describe viscous solutions being dispensed to a scrubbing or wiping apparatus by means of a pump action, such as U.S. Pat. No. 4,319,852 to Bell; U.S. Pat. No. 4,893,957 to Byriel; U.S. Pat. No. 5,211,494 to Baijnath; and U.S. Pat. No. 5,482,187 to Poulsen. While pumps may provide an effective delivery tool for many purposes, this high cost design makes it an inefficient alternative to the common bathroom brushes of today.

Finally, U.S. Pat. No. 4,875,791 to Hassan illustrates a liquid dispensing brush. However, since this design contains no flow control mechanism, it requires that the brush head be kept higher than the reservoir while not in use, or else the liquid flows unobstructed to the brush head. This makes the design impractical for most bathroom cleaning uses since most people store their toilet bowl and other bathroom brushes standing or hanging with the brush head below the handle.

Due to the lack of a better device, the "old" system of having a brush with a separate container for disinfectant or cleaner is still found in widespread use. Accordingly, what is needed is an improved cleaning and disinfecting method and apparatus for bathroom, household or other use.

SUMMARY OF THE INVENTION

The preferred embodiments of the present invention overcome the problems identified above by providing a cleaning device enclosing a reservoir contained in a hollow handle for storing a cleaning solution, with a cap connected to one end of the handle and a base connected to the other end of the handle. A brush, sponge or other scrubber or cleaning surface is preferably attached to the base. A manually operated flow control mechanism opens a valve which seals at least one exit or dispensing orifice at or near the base of the reservoir, and thereby allows volume of cleaning solution to be dispensed at a reasonably fast, controlled rate of flow. In one embodiment, manually operated vacuum pressure release orifices are located at the opposite end of the reservoir from the exit orifice and are normally closed, but may be opened to minimize or eliminate any vacuum (subatmospheric pressure) in the reservoir, thereby aiding the flow of liquid from the reservoir through the exit orifice.

In one embodiment of the present invention, the cleaning device comprises a handle having a proximal end and a distal end and at least partially enclosing a reservoir therein for containing solution. A cap is removably connected to the proximal end of the handle. A base is connected to the distal end of the handle, with at least one exit orifice in the base for releasing solution from the reservoir. At least one pressure release opening is provided in the cap for regulating pressure within the reservoir. A rod having a proximal end and a distal end extends within the reservoir between the cap and the base, the rod being connected at its distal end to a sealing member. When the rod is in a first position the sealing member forms a seal with the at least one orifice, and when the rod is in a second position the sealing member is spaced apart from the at least one orifice to release solution from the reservoir. An actuator is positioned partially within the cap and extends at least partially outside of the cap. The actuator is operably connected with the proximal end of the rod such that when the actuator is depressed, the rod moves from its first position to its second position. Moreover, when the rod is in its first position a seal is formed against the at least one pressure release opening, and when the rod is in its second position, the seal is removed from the at least one pressure release opening.

In another embodiment, the cleaning device comprises an elongate body having a proximal end and a distal end and having a reservoir contained therein. A cleaning surface is provided at the distal end of the elongate body. At least one pressure release opening is provided at the proximal end of the body, and at least one exit orifice is provided at the distal end of the body. A first sealing member is coupled to the at least one exit orifice, the first sealing member being moveable away from the orifice to release solution from the reservoir. A second sealing member is coupled to the at least one pressure release opening, the second sealing member being moveable away from the pressure release opening to release vacuum pressure from within the reservoir.

In another embodiment, the cleaning device comprises an body enclosing a reservoir capable of receiving and holding a liquid. A cleaning surface is provided adjacent one end of the body. An outlet valve is provided adjacent the one end of the body adjacent the cleaning surface, the outlet valve capable of allowing the liquid to exit the reservoir. A pressure release valve is provided adjacent another end of the body for regulating pressure within the reservoir.

In another embodiment, a method of cleaning a location is provided. This method comprises providing solution in a body enclosing a reservoir, the body having a cleaning surface at least on one side thereof. An exit valve is opened at a location generally opposite the exit valve in the body adjacent the cleaning surface for releasing solution from the reservoir. A pressure release valve is also opened in the body for regulating pressure in the reservoir. The location is cleaned by applying the cleaning surface in contact with the solution released from the exit valve against the location.

The preferred embodiments described herein are able to provide a number of advantages over previously known cleaning devices, including the following:

a. The preferred embodiments provide an improved cleaning device with an improved mechanism to dispense a liquid cleaning or disinfecting solution from a reservoir within either a handle or base through a flow control mechanism to a scrubbing or wiping medium, thereby eliminating the need for the commonly used separate solution dispenser.

b. The preferred embodiments provide a cleaning device which, when used, improves the sanitary condition of the area being cleaned, such as around toilets and other bathroom fixtures.

c. The preferred embodiments provide a cleaning device that is easy to fill, convenient to use, and sanitary to store.

d. The preferred embodiments provide a cleaning device which will not deliver solution or drip without prescribed action by the user, and when so prescribed, can deliver continuous flow or controllable amounts of cleaning or disinfectant solution.

e. The preferred embodiments provide a cleaning device which will hold sufficient cleaning or disinfectant solution for at least one week of normal household use.

f. The preferred embodiments provide a cleaning device which can hold sufficient cleaning or disinfectant solution to make it practical for commercial use.

g. The preferred embodiments allow different methods to deliver controllable amounts of cleaning or disinfectant solution to the scrubber head. The preferred methods operate using a simple and cost effective mechanism to open one or more otherwise sealed orifices at the base or side of the reservoir. As only one example, an orifice can be opened by a valve which is normally held closed by a plunger with an axially mounted compression spring. When desired, the plunger can be manually depressed from one or several of a variety of remote positions on the outside of the shaft of the device, thereby causing the orifice to be opened and allowing cleaning or disinfectant solution to flow from the reservoir to the scrubber head in either continuous flow or a fixed controlled amount, depending on the valve design.

Further objectives and advantages of the present invention are to provide a cleaning device that is cost effective to manufacture, simple to operate, and rugged in construction. Further objectives will become apparent from a consideration of the drawings and ensuing descriptions.

DETAILED DESCRIPTION OF THE PREFERRED EMBODIMENTS

The preferred embodiments of the present invention describe a method and apparatus for dispensing cleaning solution, such as for toilet, bathroom or household use. The particular embodiments described below include a brush designed for cleaning and disinfecting toilets and urinals. However, it will be appreciated that designs for other cleaning applications, such as for cleaning and disinfecting bathroom and kitchen sinks and showers and other household and non-household areas, are also contemplated as being within the scope of this invention. Furthermore, the embodiments of the present invention may also be applied to other applications wherein it is desired to dispense a volume of solution to a surface for cleaning or other purposes.

As used herein, the terms "liquid," "solution," "gel," "cleanser" and "disinfectant" are interchangeable and include, but are not limited to, materials in all phases, although preferably not in gas or non-flowable solid phase.

The term "rigid" refers to materials that are preferably not more than about 10% deformable by the average human hand. It will be appreciated, however, that materials that are more than about 10% deformable may still be considered "rigid."

The term "semi-rigid" refers to materials that are preferably between about 10% and about 20% bendable by the average human hand. It will be appreciated, however, that materials that are bendable outside of this range may still be considered "semirigid."

The term "squeezable" refers to materials that are preferably more than about 20% compressible by the average human hand. It will be appreciated, however, that materials compressible outside of this range may still be considered "squeezable."

The term "handle" is hereby defined to include the support for the cleaning surface or any other part of the cleaning device capable of at least partially enclosing a cavity or reservoir.

Figure 1:
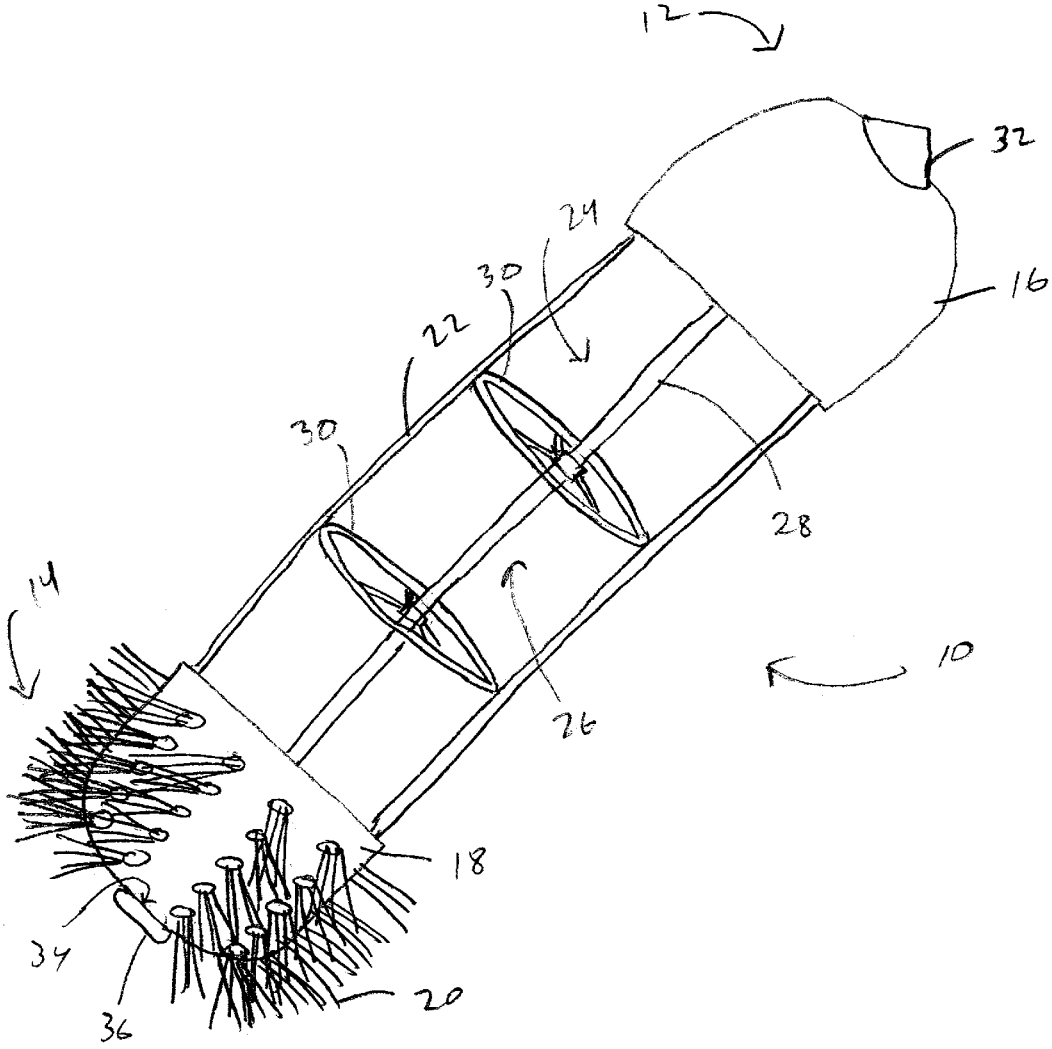
FIG. 1 is a perspective view of a cleaning device according to one embodiment of the present invention.

FIG. 1 illustrates one preferred cleaning device 10 comprising an elongate body having a proximal end 12 and a distal end 14. The elongate body of the cleaning device preferably includes a cap 16 at its proximal end, a base 18 at its distal end having a plurality of bristles 20, and a handle 22 extending between the cap 16 and the base 18. As illustrated, the handle 22 is preferably a transparent hollow tube, defining a reservoir 24 therein. Extending within the reservoir 24 is a plunger assembly unit 26, described in further detail below, having a rod 28 and a plurality of stabilizers 30. The cap 16 preferably includes a plunger which is more preferably a rubber button 32 that can be depressed into the cap 16. The base 18 preferably includes an exit orifice 34, with the rod 28 extending through the orifice 34 and having a sealing member 36 attached to the distal end thereto. The rod 28 is preferably operably connected to the button 32 such that when the button is depressed, the rod moves the sealing member 36 away from the orifice 34 to allow fluid contained within the reservoir 24 to escape through the orifice. Further details of this mechanism are described below.

Figure 2:
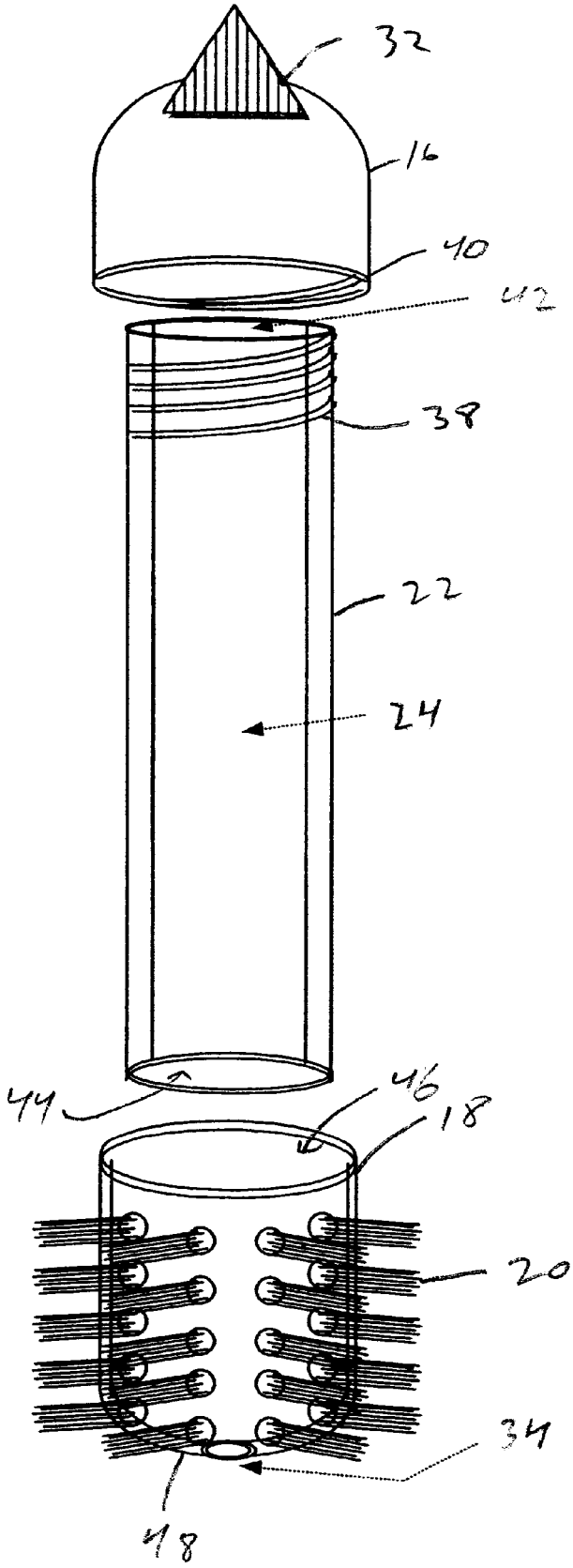
FIG. 2 is an exploded perspective view showing the cap, handle and base of the cleaning device of FIG. 1.

FIG. 2 illustrates an exploded view of the cleaning device 10, more particularly showing the cap 16, the handle 22 and the base 18, but without showing the plunger assembly unit 26. In the illustrated embodiment, the proximal end of the tubular handle 22 has external threads 38 to engage internal threading 40 within the cap 16. Thus, the cap 16 can be screwed onto and off of the handle 22. When the cap 16 is removed from the handle 22, a fill opening 42 is exposed at the top end or proximal end of the handle for pouring solution into the reservoir 24. The base 18 is preferably attached to the distal end of the handle 22 to enclose the reservoir 24 at the open end 44 of the handle 22. This attachment is made in the illustrated embodiment by gluing the base 18 to the handle 22, although it will be appreciated that other means for attaching, such as threading and snap-fitting, are also contemplated. The base 18 and the handle 22 may also be integrally formed.

It will be appreciated that the handle 22 and cap 16 may also be permanently attached or integrally formed. In this embodiment, a separate fill opening is preferably provided either in the body of the handle or the cap in order to provide solution into the reservoir. This separate fill opening would preferably be capable of being opened and closed in order to seal the reservoir, such as by opening and closing a cap.

In one embodiment, the handle 22 of the device is preferably extruded from a straight tube of any of a number of plastics or other rigid or semi-rigid materials. The handle may also be made to be squeezable to assist in the delivery of solution from the orifice 34. The materials for the handle can be transparent, translucent, or opaque depending on the desired aesthetics or practical requirements of the particular cleaning device. Although not required, an ability to see into the hollow interior of the handle 22 is preferable as it will serve to identify the level of cleansing solution in the reservoir 24. The handle may also be molded or machined into a wide variety of shapes and sizes as desired for any number of applications. Thus, the handle may be, but is not limited to being, bent, ergonomically contoured, or partially ribbed. Additionally, different materials can be used together to define practical and aesthetic specifics for the handle, for example by gluing, joining, or otherwise attaching separate pieces together. The materials used to construct the handle 22 are preferably carefully selected to ensure that they are sturdy enough to withstand the demands of being used as a household or commercial brush. Furthermore, the materials selected are preferably resistant to cracking, leaking, or, when in contact with the cleaning or disinfectant solution which will be held by the reservoir 24, even chemically reacting with the solution.

The base 18 illustrated in FIG. 2 preferably includes a cleaning surface, and more particularly is a brush head having a plurality of bristles 20. The base 18 is preferably a tubular shaped member having an open end 46 and a bottom closed surface 48, such that part of the reservoir for solution is contained within the base. At least one dispensing orifice 34 is disposed in the closed bottom surface 48 of the base 18. This orifice 34 may also be an unused hole where bristles are normally placed. It will also be appreciated that multiple orifices may be provided in the base 18.

Other embodiments of the cleaning device 10 are that it can have wrinkled or coiled bristles which would help hold soap or other disinfectants or cleansers. Moreover, the base 18 need not be tubular in shape, but preferably need only be shaped and configured to enclose the reservoir 24. The base 18 can also include other cleaning surfaces in addition to or instead of bristles, such as but not limited to sponges, coiled plastic scrubbers, massaging surfaces, cross action brushes, scour pads, or any currently available or reasonably foreseeable cleaning surfaces. It will also be appreciated that the base need not have a separate cleaning surface at all, but may form the cleaning surface itself. In this embodiment, the abrasive compound may be in the cleansing liquid itself, and the base 18 would have no bristles, but only one or more dispensing orifices.

Figures 3, 4:
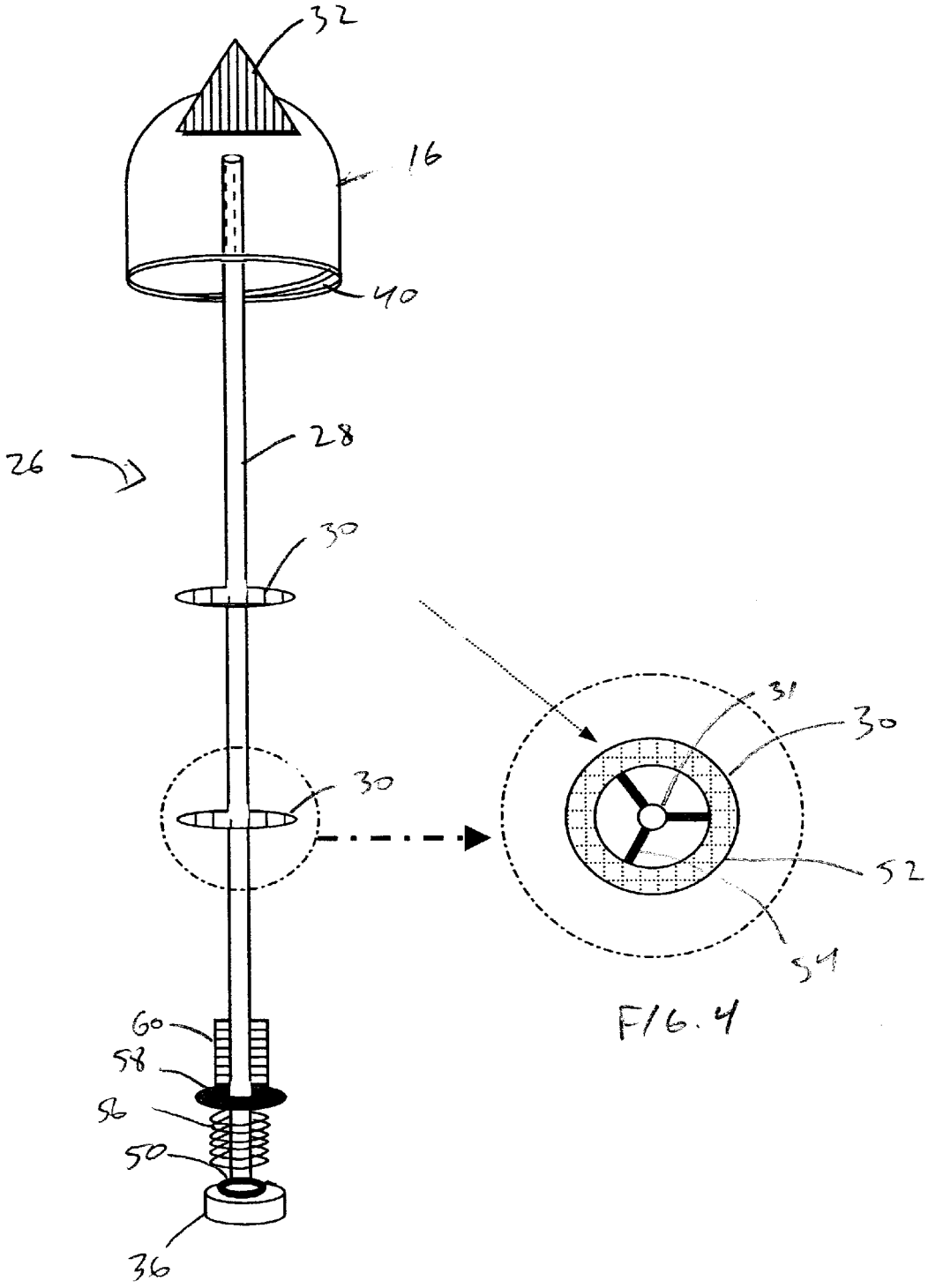
FIG. 3 is a perspective view of the cap and plunger assembly unit of the cleaning device of FIG. 1, with the cap shown partially cut-away.
FIG. 4 is a top view of a stabilizer fixed to the plunger assembly unit of FIG. 3.
Figures 5, 6:
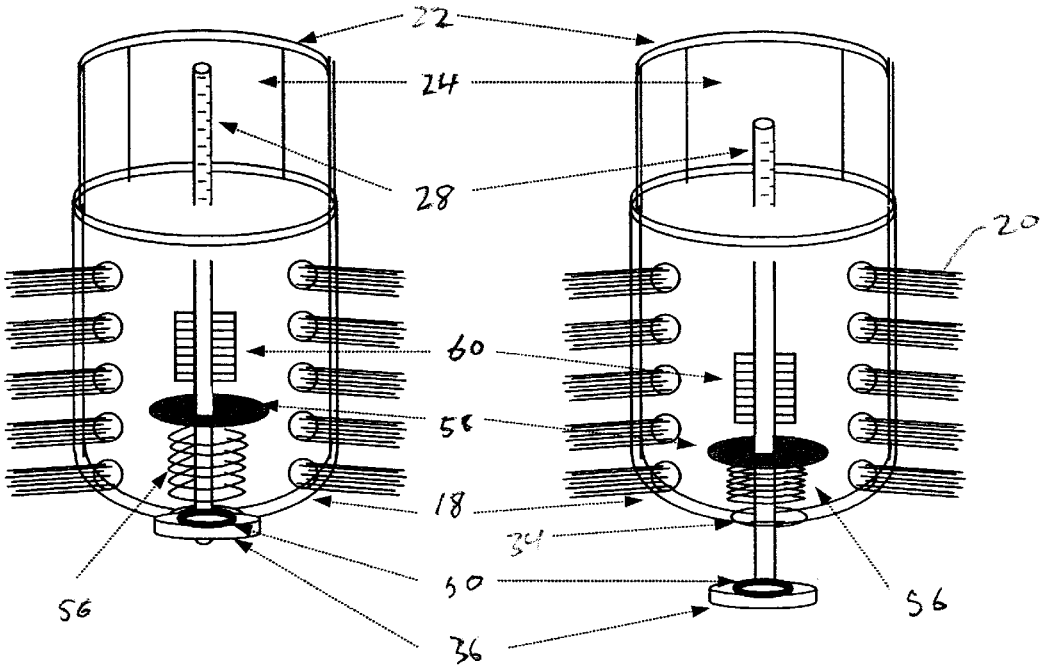
FIG. 5 is a partial cut-away of the distal portion of the cleaning device of FIG. 1, illustrating the device in a closed position.
FIG. 6 is a partial cut-away view of the distal portion of the cleaning device of FIG. 1, illustrating the device in an open position.

FIG. 3 illustrates more particularly the cap 16 as it is connected to the plunger assembly unit 26. The plunger assembly unit 26 preferably includes an elongate rod 28 extending from the plunger or rubber button 32 at its proximal end to the sealing member 36 at its distal end. The rod is preferably made from any suitable rigid material, such as plastic or metal. The sealing member 36 is either integrally attached or separately connected to the rod 28. In one preferred embodiment, the sealing member 36 is a disc-shaped member having a circumference that is larger than that of the orifice 34. Preferred materials for the sealing member 36 include but are not limited to plastics and rubber. A grommet 50, which is more preferably a rubber ring, is attached to rod 28 proximal the sealing member 36. As illustrated in FIG. 5 below, the grommet engages the orifice when the cleaning device is in its closed position to help prevent fluid from escaping through the orifice.

It will be appreciated that the button 32 may take any desired form in order to allow the user to press down on the rod 28 to cause it to move in a distal direction. The shape of the rubber button 32 may help to ensure the rod 28 always remains in a centered position on the cap 16, for example, by having a recess for receiving the rod 28. The rod 28 may also be fixedly attached to the button 32. In another embodiment, the entire cap 16 may be made of rubber. Alternatively, the entire cap 16 may be moveable relative to the handle 22 using, for example, a spring mechanism. Further details of such an embodiment are described below with respect to FIG. 17.

As illustrated in FIGS. 3 and 4, a plurality of stabilizers 30 are preferably attached to the rod 28 to ensure that the rod 28 does not bend either in the standby mode as shown in FIG. 5 or when depressed as shown in FIG. 6. In one embodiment, these stabilizers 30 are fixedly attached to the plunger rod 28, and contact the interior wall of the reservoir 24 at more than one point. Moreover, the stabilizers 30 are preferably provided with an outer ring 52, which may be made out of any desirable material such as plastic or rubber. Because this ring 52 contacts the wall of the reservoir 24, it is preferred that the ring 52 be constructed of a material that does not create excessive friction with the wall. The outer ring 52 is connected to the rod 28 using a plurality of spokes 54 which come together at a central ring 31, with the solution in the reservoir being allowed to pass between the spokes. The central ring 31 is preferably fixed to the rod 28.

It will be appreciated that the stabilizer 30 need not be fixed to the rod 28, but may be fixed to the walls of the reservoir. In this embodiment, the ring 31 is capable of sliding relative to the rod 28.

As shown in FIGS. 3, 5 and 6, the rod 28 also preferably includes a blocking member 58, described further below, fixed to the rod 28, with a compression spring 56 positioned between the blocking member 58 and the sealing member 36 and grommet 50 around the rod. When the rubber button 32 is depressed, the rod 28 moves distally, causing the blocking member 58 to compress the spring 56 against the base 18 while simultaneously causing the sealing member 36 to move away from the orifice 34. When the force on the rubber button 32 is removed, the spring returns to its relaxed state, pushing the blocking member away from the orifice 34 and causing the sealing member 36 to close against the orifice 34. Accordingly, the combination of the orifice 34 and the sealing member 36 forms an exit valve for controlling release of solution from the reservoir.

It will be appreciated that although the preferred embodiments describe a proximal to distal movement of the rod to open the orifice 34, the orifice can be opened in other ways. For example, the rod and sealing member can be pulled proximally instead of pushed distally, or can slide or rotate to displace the sealing member from the orifice 34. Furthermore, it will be appreciated that the rod 28 is not necessary to open the orifice, and other mechanisms may be used as well. One example may be the use of pressure modified nipples.

Furthermore, although a spring has been described above as providing a resistive force that hinder a pushing, pulling, sliding, or rotating of the sealing member from a sealing position for the orifice 34, other methods for providing a resistive force can also be used. Commonly used resistive forces are often, but not exclusively, designed from metal, plastic, or rubber, and can be described as leaf or coiled springs, rubber or other elastomers, liquid or gas pressure systems, gravity, friction, or other responses to jarring force. These resistive forces can be used by themselves or in combination with each other. However, the preceding is not an exhaustive list. Any other currently known or expected mechanisms to operate the valve for the or creating an opening are envisioned.

The valve defined by the orifice 34 and the sealing member 36 can preferably be designed as either a metered type system or alternately, it can be a continuous flow system. Metered flow is preferably provided by the blocking member 58, which defines a disc having a diameter substantially larger than the diameter of the orifice 34. This blocking member 58 is preferably fixedly attached to the rod, and may be made of any suitable material such as plastic. When the rod 28 moves distally to open the orifice, the blocking member acts to simultaneously partially close off the interior side of the orifice. The delay between the opening on one side and the closing on the other will determine the amount of flow to be metered. This delay can be adjusted by changing the distance between the orifice 34 and the blocking member 58.

A continuous flow system would simply eliminate this blocking member from the plunger rod assembly 26. However, without a blocking member 58, a spring holder would be used to hold the spring 56 in place. As shown in FIG. 3, a spring holder 60 may be fixed to the rod for accomplishing this particular continuous flow design.

For practical as well as aesthetic reasons, the orifice 34 shown in FIGS. 5 and 6 may include an indented seated area for the sealing member 36 so that the sealing member 36 does not protrude extensively from the rest of the exterior surface of the device. As described above, a rubber grommet 50 may be used to properly seal the orifice. In addition, Teflon or other hydrophobic materials may also be provided at the orifice to provide a better seal.

In the operation of the device 10, which is described as a toilet bowl brush, the user first unscrews the fill opening cap 16 if the reservoir is empty and then pours commonly used household cleanser or disinfectant solution through the fill opening 42 until the reservoir 24 is full, and replaces the fill opening cap 16. The device is now ready for use. The manner of using the cleaning device for scrubbing is similar to that of a common toilet bowl brush in present use, whereby the user places the brush into the toilet bowl. Although not required, the preferred method would have the user keep the orifice above the waterline of the toilet bowl.

In standby mode, the reservoir outlet opening 34 remains closed as shown in FIG. 5. When desired, the user presses on the rubber button 32, depressing the plunger rod 28, compressing the spring 56 and thereby opening the reservoir outlet opening 34 by moving the sealing member 36 distally as shown in FIG. 6. Solution exits the reservoir 24 preferably by gravity feed, and then the user would proceed to scrub the interior of the bowl. When the force on the rubber cap is removed, the spring 56 returns to its relaxed position, pushing against the blocking member 58 to cause the rod 28 to move proximally and close the orifice 34 by reseating the sealing member 36 against the orifice. Once finished, the toilet can be flushed, the brush 18 rinsed off in the clean water supply in the bowl, and the device returned to its holder.

FIGS. 7–16 illustrate another embodiment of a cleaning device in accordance with the present invention. More particularly, FIGS. 7–16 illustrate a toilet bowl brush similar to that described above, although it will be appreciated that other devices for cleaning and dispensing fluid are contemplated as well as falling within the scope of the present invention.

Figure 7:
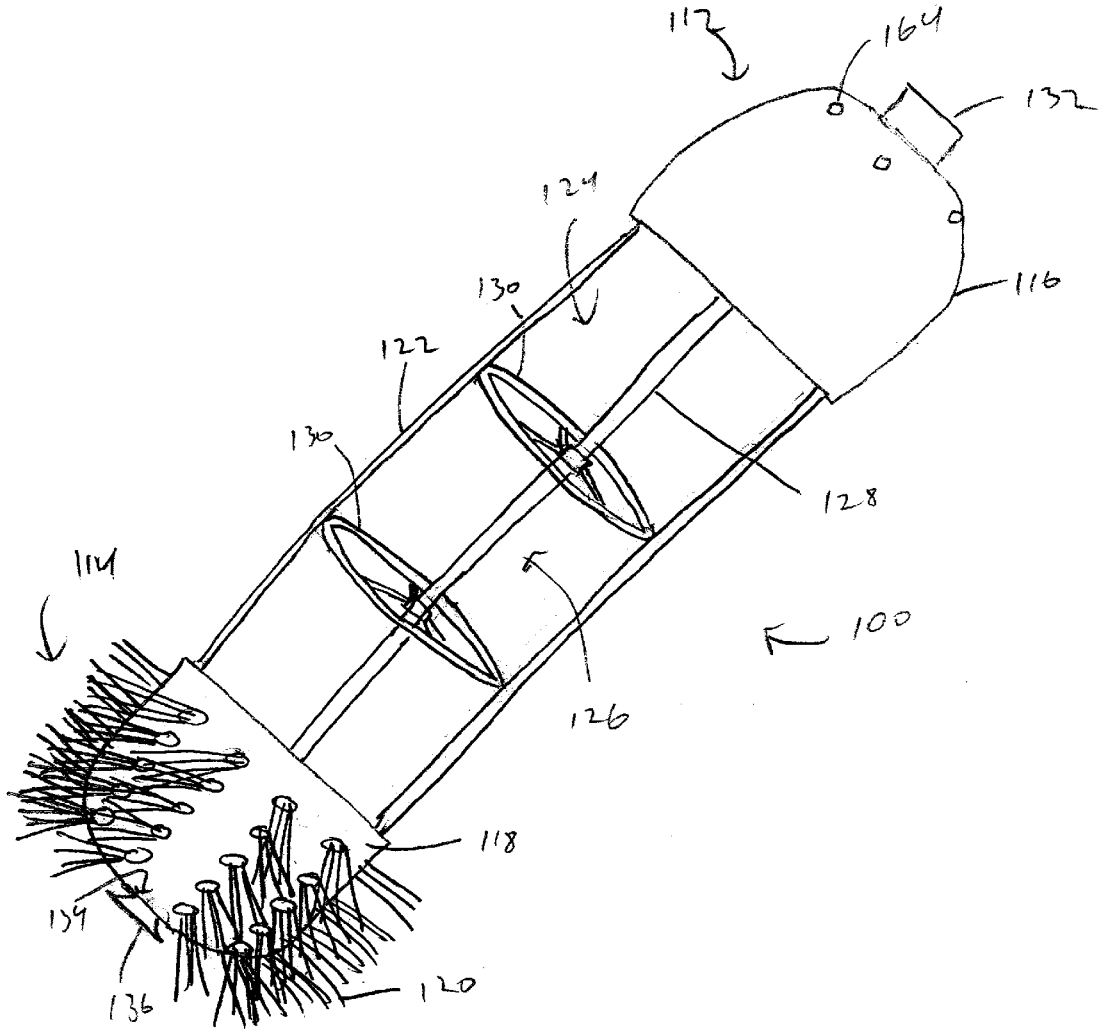
FIG. 7 is a perspective view of a cleaning device according to another embodiment of the present invention.

As shown in FIG. 7, like the device of FIG. 1 above, the device 100 preferably includes an elongate body having a proximal end 112 and a distal end 114. The elongate body of the cleaning device preferably includes a cap 116 at its proximal end, a base 118 at its distal end having a plurality of bristles 120, and a handle 122 extending between the cap 116 and the base 118. The elongate body preferably encloses a reservoir 124, which is more preferably enclosed by the cap 116, base 118 and handle 122. Extending within the reservoir 124 is a plunger assembly unit 126, described in further detail below, having a rod 128 and a plurality of stabilizers 130. The cap 116 preferably includes a cylindrical plunger 132 that can be depressed into an opening in the cap 116, and further includes a plurality of vents 164. The base 118 preferably includes an exit orifice 134, with the rod 128 extending through the orifice and having a sealing member 136 attached to the distal end thereto. The rod 128 is preferably operably connected to the plunger 132 such that when the plunger is depressed, the rod moves the sealing member 136 away from the orifice 134 to allow fluid contained within the reservoir 124 to escape through the orifice. Further details of this mechanism are described below.

Figure 8:
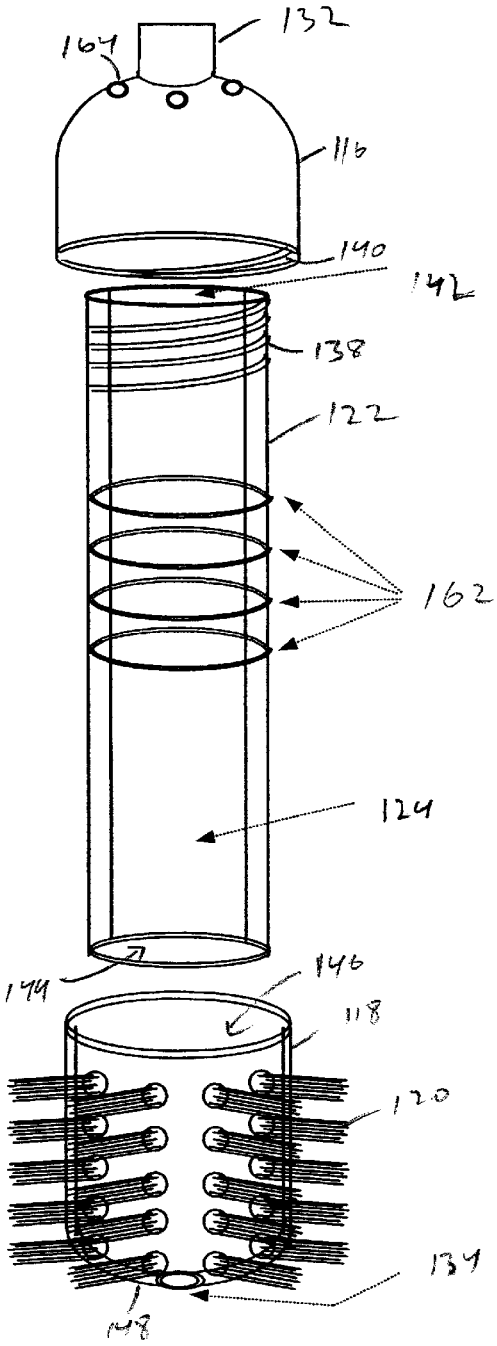
FIG. 8 is an exploded perspective view showing the cap, handle and base of the cleaning device of FIG. 7.

FIG. 8 illustrates an exploded view of the cleaning device 100, more particularly showing the cap 116, the handle 122 and the base 118, but without showing the plunger assembly unit 126. In the illustrated embodiment, the proximal end of the tubular handle 122 has external threads 138 to engage internal threading 140 within the cap 116. Thus, the cap 116 can be screwed onto and off of the handle 122. When the cap 116 is removed from the handle 122, a fill opening 142 is exposed at the top end or proximal end of the handle for pouring solution into the reservoir 124. The base 118 is preferably attached to the distal end of the handle 122 to enclose the reservoir 124 at the open end 144 of the handle 122. This attachment is made in the illustrated embodiment by gluing the base 118 to the handle 122, although it will be appreciated that other means for attaching, such as threading and snap-fitting, are also contemplated. Further details of the cap, handle and base are described with respect to the embodiment of FIG. 1 above.

As illustrated, the handle 122 is preferably a transparent hollow tube, defining a reservoir 124 therein, and made of materials similar to that described for the handle 22 above. More particularly, as shown in FIG. 8, subtle or directly visible markings 162 on the reservoir wall can help identify volumes of liquid remaining. Additionally, markings which identify numbers of recommended doses of cleanser remaining in the reservoir can be added. This embodiment allows the user to release the same amount of cleanser each time by simply releasing cleanser until the visible level of cleanser reaches the next "tick mark".

The handle 122 can be manufactured in the same manner as described for the handle 22 above. There is a tradeoff between the aesthetic qualities of a narrow and sleek handle versus the practical qualities of larger diameter/circumference handles. For example, increased handle width may not be aesthetically as pleasing, but it allows interior reservoir volume to increase exponentially and also improves the strength of the handle allowing the wall thickness to be thinner. Shaping of the handle therefore preferably considers maximizing internal reservoir volume and handle strength, yet maintains a slender portion for the operator to grip. Additionally, the handle should be designed to keep all dimensions of the handle small enough to prevent inhibiting the scrubbing process, for instance, in the scrubbing of a toilet bowl. For example, a large diameter at any particular part of the handle may be counterproductive as opposed to a continuously thick handle. This obviously means that the handle does not necessarily need to be of uniform width or thickness. In one embodiment, it is preferably designed with a thicker reservoir holding section at the bottom and middle of the reservoir, and a narrower section near the top thereby allowing a more comfortable location for the user to grasp during use.

The base 118 illustrated in FIG. 8 preferably includes a cleaning surface, and more particularly is a brush head having a plurality of bristles 120. The brush head 118 is preferably a tubular shaped member having an open end 146 and a bottom closed surface 148, with at least one dispensing orifice 134 in the closed bottom surface 146. This orifice 134 may also be an unused hole where bristles are normally placed. It will also be appreciated that multiple orifices may be provided in the brush head. Other embodiments for the base are also contemplated, as described above.

Figure 9:
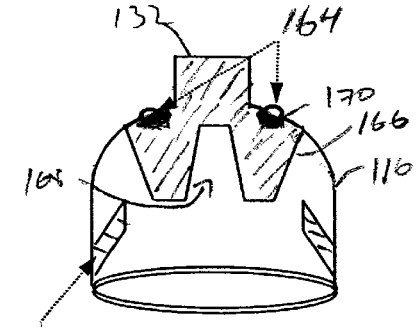
FIG. 9 is a partial cross-sectional view of the cap of FIG. 8 in its closed position.
Figure 10:
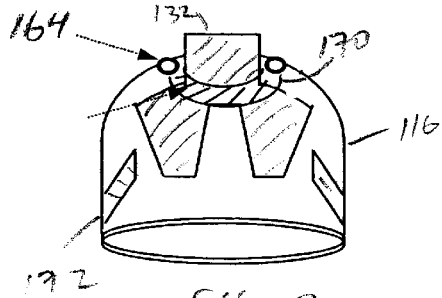
FIG. 10 is a partial cross-sectional view of the cap of FIG. 8 in its open position.
Figure 11:
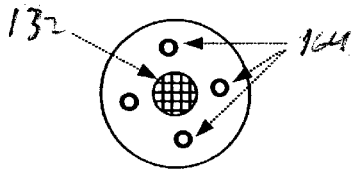
FIG. 11 is a top view the cap of FIG. 8.

The cap 116, shown more particularly in FIGS. 9–11, can be made completely or partially out of any of a number of materials but one preferred embodiment has it made from a thermoplastic material. The cap 116 preferably is internally threaded with threads 140 to be screw mounted onto the handle 122, although any number of ways of attaching the cap 116 to the handle may be used, including but not limited to snap-mounting, bayonet mounting and pressure-mounting.

Figure 12A:
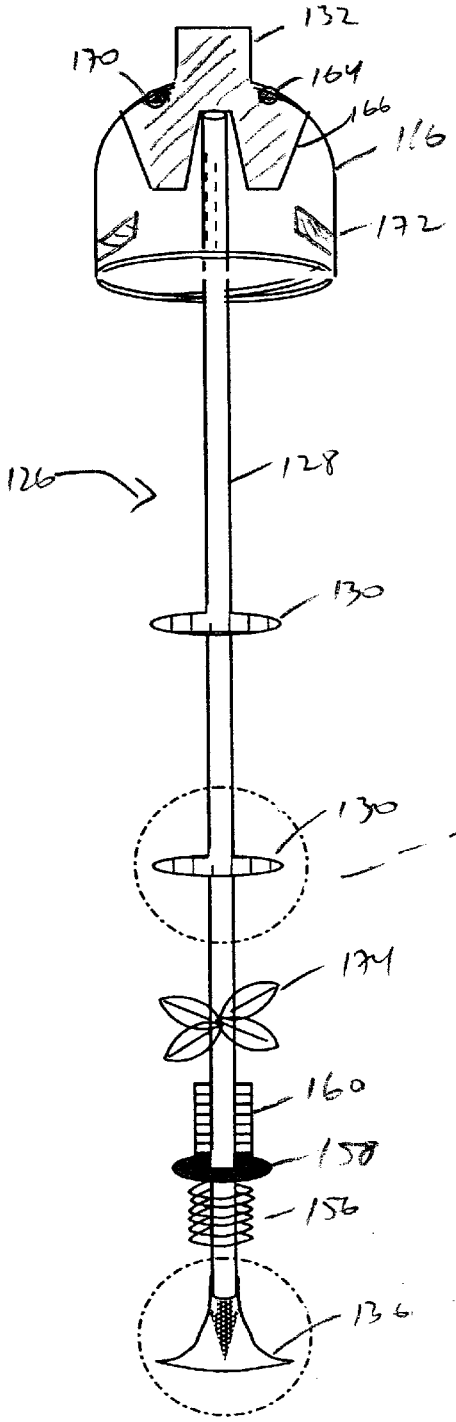
FIG. 12A is a perspective view of the cap and plunger assembly unit of FIG. 8, with the cap shown in partial cross-section.

As shown in the partial cross-sectional view of the cap 116 in FIG. 9, a cylindrical plunger 132 protrudes from the top of the cap 116 in the same way as the push cap on an inexpensive spring-loaded, standard cartridge design ball point pen protrudes from the top of the pen. Again, like the cartridge in a ball point pen design, the plunger 132, as shown in FIG. 12A described below, is spring loaded to keep the exit orifice 134 closed. The plunger 132 is normally held at its most extended position (i.e., at its farthest position from the orifice 134) by the spring compression force counteracted by a plunger assembly cap lip 166 which is preferably integrally formed around the base of the plunger 132. Together, the plunger 132 and cap lid 116 form the actuator for the plunger assembly unit 126. The plunger cap lip 166 preferably includes a central cone-shaped recess 168 for receiving the plunger rod 128 described below. Thus, as a pen push cap can be pushed down to active the ink cartridge to its in-use position, the plunger 132 can be pressed down, thereby activating the plunger assembly unit to move.

The cap 116 preferably includes a plurality of vents or pressure release valves disposed around the plunger 132, as shown in FIG. 11. Many methods to design the valves are possible, but in one preferred embodiment, the valves are provided merely be having one or more small holes in the cap 116. These holes 164 are preferably sealed when the plunger 132 is in its extended position of FIG. 9 (i.e., the device is closed/standby mode), and unsealed when the plunger is depressed as shown in FIG. 10. This can be accomplished by designing a sealing surface 170 such as a rubber gasket or washer which is attached to the plunger assembly cap lip 166 around the base of the plunger 132 which seals the pressure release openings 164 when the plunger 132 is in its standby (most extended) position. As the plunger 132 is pressed into the cap 116, as shown in FIG. 10, the seal is broken and the gasket or washer 170 is displaced away from the openings 164. When the plunger 132 is released, the lip 166 returns to its standby position and the pressure release openings 164 are automatically resealed.

With no modifications, the plunger 132 can be pressed until it is fully pushed into the cap 116. However, in one preferred embodiment shown in FIGS. 9 and 10, the device 100 includes blocking members 172 on the interior wall of the cap 116. As the lip 166 move distally toward the orifice 134, the walls of the lip 166 engage the blocking members 172 to prevent further movement of the rod. Although these blocking member are shown as being protrusions on the interior wall of the cap 116, it will be appreciated that they may be formed in other ways as well. Another embodiment has a blocking member 172 included as an integral part of the plunger assembly unit described below which, as the plunger assembly unit is depressed, presses against a fixed surface along the route of travel of the plunger. Any of these embodiments cause the plunger 132 to be stopped at some fixed distance of travel from its standby position, and thereby limit the distance of travel of the sealing member 136 away from the exit orifice 134. This may be preferable to ensure that moving parts do not become snagged in their route of travel, thereby resisting complete movement back to the standby sealed position.

FIG. 12A illustrates more particularly the cap 116 as it is connected to the plunger assembly unit 126. The plunger assembly unit 126 preferably includes an elongate rod 128 extending from the recess 168 of the lip 166 at its proximal end to the sealing member 136 at its distal end. The rod 128 is preferably made of a stiff material so that it does not buckle. In another embodiment, the rod 128 is designed with a cross-shaped cross-sectional pattern along its length to improve resistance to buckling, while maintaining the rod 128 centered in the exit orifice 134 and maximizing the flow area available when the orifice seal is manually released. It will be appreciated that other cross-sections are possible for the rod, including star-shaped cross-sections and other non-circular cross-sections. By utilizing noncircular cross-sections for the rod, when the rod 128 is moved such that the sealing member 136 is distal to the orifice 134, more solution may be allowed to escape through the orifice, as less of the cross-sectional area of the orifice is occupied by the rod itself.

Figure 14:
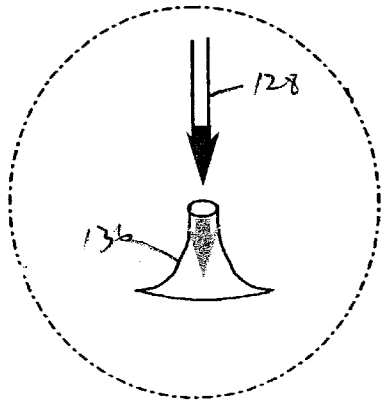
FIG. 14 is an assembly view illustrating the insertion of the plunger rod of FIG. 12A into a sealing member.
Figures 15, 16:
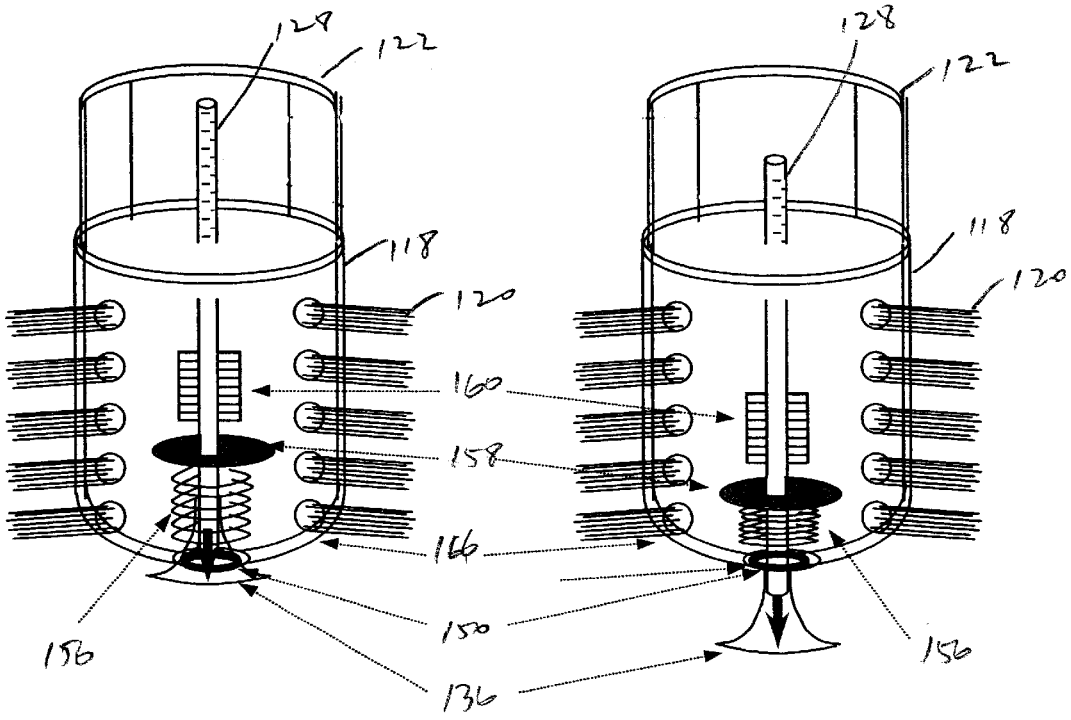
FIG. 15 is a partial cut-away of the distal portion of the cleaning device of FIG. 8, illustrating the device in a closed position.
FIG. 16 is a partial cut-away view of the distal portion of the cleaning device of FIG. 8, illustrating the device in an open position.

The distal end of the rod 128 is preferably inserted into a conical sealing member 136 that keeps the orifice 134 sealed from the outside, as shown in FIG. 15. Alternatively, the sealing member can seal the orifice from the inside. When desired, a user of the device can operate a control to open the seal by pushing, pulling, sliding, or rotating the sealing member 136 from its sealing position relative to the orifice, depending on how the device is designed. In the embodiment shown in FIGS. 12–16, the sealing member 136 is operated by moving the rod 128 distally to move the sealing member 136 away from the orifice 134, as described further below.

Figure 13:
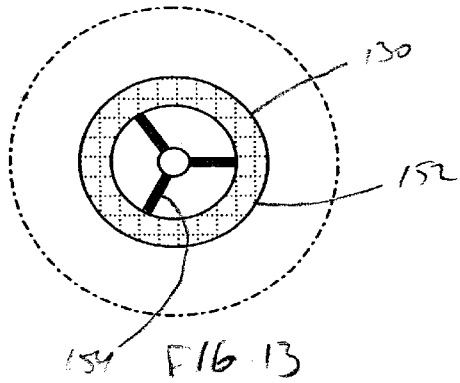
FIG. 13 is a top view of a stabilizer fixed to the plunger assembly unit of FIG. 12A.

As illustrated in FIGS. 12A and 13, a plurality of stabilizers 130 are preferably attached to the rod 128 to ensure that the rod 128 does not bend either in the standby mode as shown in FIG. 15 or when depressed as shown in FIG. 16. These stabilizers may be substantially as described with respect to the stabilizers 30 above. Furthermore, similar to the embodiment described above, the rod 128 also preferably includes a blocking member 158 fixed to the rod 128, with a compression spring 156 positioned between the blocking member 158 and the sealing member 136 around the rod 128. This blocking member preferably allows for metered flow through the orifice 134 as described above. Alternatively, a spring holder 160 may be provided in designs without a blocking member 158 in order to support the spring 156 while providing a continuous flow design, as described with respect to FIGS. 12B and 12C below.

FIG. 12A further illustrates that the rod 128 may also have attached thereto a pressure enhancing device 174. Since the gravity feed of the solution in the reservoir 124 will be highly dependent on the head pressure from the liquid column above the orifice 134, and such pressure will vary considerably due to the amount of the liquid in the reservoir, the pressure enhancing device 174 preferably enhances the force of the gravity feed by increasing positive pressure in the reservoir or forcing flow toward the orifice. In the embodiment shown, fan blades are provided which allow liquid to pass through but also act to add force to the liquid as it moves toward the orifice. Another embodiment contemplated is a device which adds pressure above the liquid column, such as a diaphragm, bulb, or other simple and economic pumping mechanism. It will also be appreciated that any sort of pressure modifying device may be provided in the reservoir, either to increase or decrease the pressure therein.

One preferred embodiment for attaching the sealing member 136 to the rod 128 is shown in FIG. 14. The distal end of the rod 128 is press fit into a rubber sealing member 136. As shown in FIGS. 15 and 16, the sealing member 136 is cone shaped allowing enough area for liquid to pass through the orifice 134 when the orifice 134 is opened as well as to help guide the sealing member 136 to a proper seated sealing position as the plunger 132 is released, thereby returning the rod 128 to its standby position.

Although a perfect airtight seal is not essential for this device because capillary and vacuum pressure will help the sealing mechanics, the seal formed between sealing member 136 and orifice 134 is preferably able to withstand jarring from aggressive use or if the device is shaken to remove excess residual liquid after use, as well as resist leaking fluid while stored for extended periods of time with the outlet orifice 134 below the liquid column in the reservoir 124. Thus, in some embodiments, in addition to the sealing member 136, a rubber disk, rubber grommets, or additional seating members may be used which are shaped to fit into a particular sized hole thereby effectively plugging the orifice. For instance, a rubber grommet 150 may be provided at the orifice 134 around the rod 128 and proximal to the sealing member 136 to assist in forming the seal, as described above and illustrated in FIGS. 15 and 16.

Figure 12B:
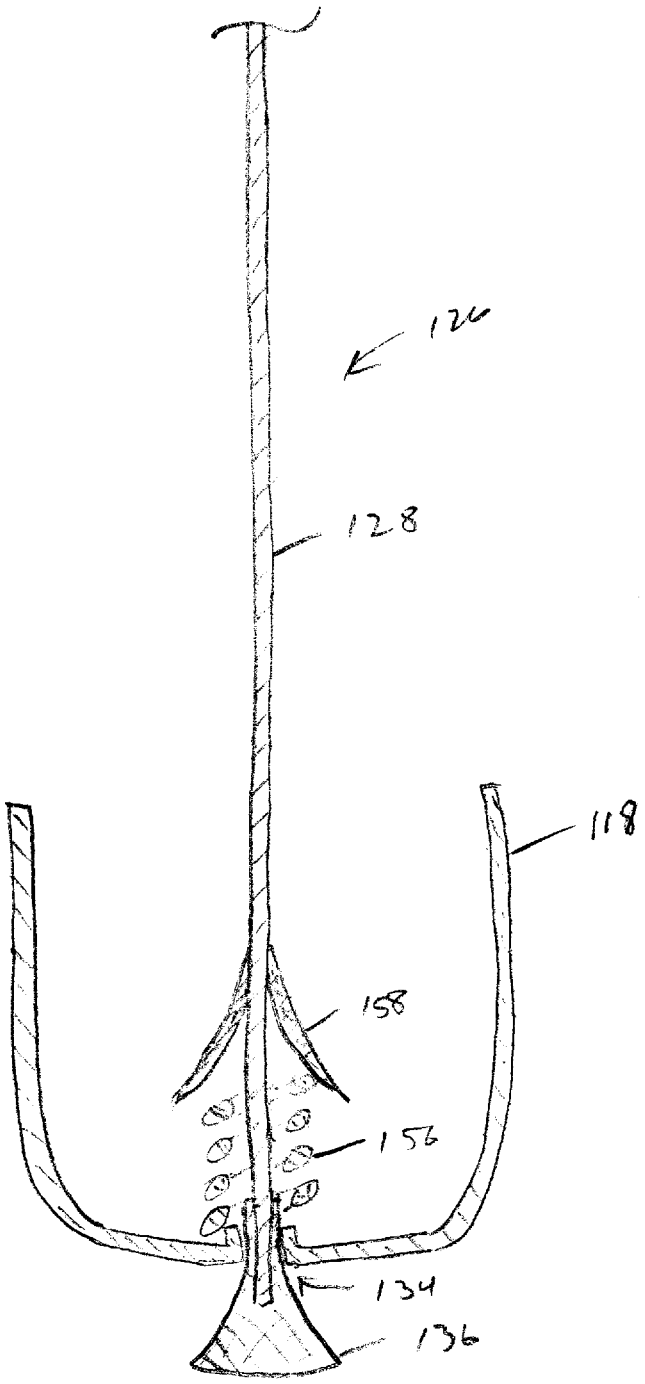
FIG. 12B is a cross-sectional view of a plunger assembly unit attached to the base of a cleaning device according to another embodiment of the present invention.

FIG. 12B illustrates an embodiment of the invention wherein neither a blocking member 158 nor stabilizers 130 are provided on the rod 126 of the plunger assembly unit 128. Thus, in this embodiment, the plunger assembly unit 126 includes a rod 128, a sealing member 136, a spring 156 and a spring support 158. The spring support 158 is illustrated as including a plurality of flexible flanges attached to the rod, which facilitates assembly of the plunger assembly unit 126 with respect to the other components of the cleaning device. More particularly, the unit is assembled by first attaching the rubber sealing member 136 to the distal end of the rod 128. Then, the proximal end of the rod 128 is inserted through the orifice 134 until the sealing member seats against the orifice. From the top of the rod 128, the spring 156 is dropped onto the rod. Because the spring support flanges 158 flare outward toward the distal end of the rod, the flanges are able to temporarily flex against the rod to allow the spring 156 to be slid thereover.

Figure 12C:
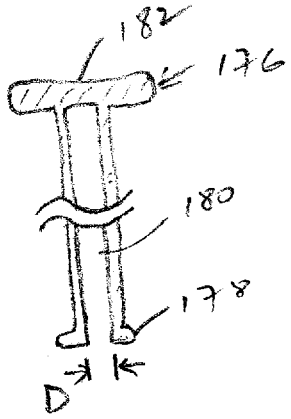
FIG. 12C is a cross-sectional view of a tool used to advance a spring over the rod of FIG. 12B.

A special spring delivery tool 176, shown in FIG. 12C, may be used to assist in sliding the spring over the flanges 158. The tool includes a base portion 178 which projects radially outwardly, with a lumen 180 extending from the base portion 178 proximally toward a handle 182 which closes off the lumen 180. The lumen 180 of the tool has a diameter 1) which is preferably just slightly larger than the diameter of the rod 128. After the spring 156 is dropped over the proximal end of the rod 128, the base portion 178 is placed over the proximal end of the rod such that the rod 128 slides into the lumen 180. As the tool 176 is moved distally over the rod 128, the base portion 178 begins to move the spring 156 distally over the flanges 158. As this distal movement continues, the lumen 180 engages the flanges 158, causing the flanges 158 to flex inwardly against the rod 128. As these flanges flex inwardly, the tool 176 pushes the spring 156 until it is distal to the flanges 158. The tool 176 can then be removed, causing the flanges to return to their relaxed position as shown in FIG. 1ZB, and the spring is in place. The outwardly extending flanges of the spring support 158 are then capable of compressing the spring 156 when the rod 128 is moved distally in operation.

It will be appreciated that the flexible flanges 158 described above may provide enough spring-like characteristics themselves such that, if the ends of the flanges are in contact with the interior of the base of the reservoir, no additional spring or spring support may be necessary for movement of the rod. In such an embodiment, as the rod 128 moves distally, the ends of the flanges would flex against the base of the reservoir. When the force on the rod is removed, the natural spring action of the flexible flanges 158 causes the rod to return to its original position. Further details of such an embodiment are described below with respect to FIG. 17.

Although not illustrated, stabilizers 130 may then be slid over the proximal end of the rod. The handle 122 may then be attached to the base 118, or alternatively, may be attached prior to insertion of the rod 128 through the orifice 134. With the handle, base and plunger assembly unit connected, the cap, such as shown in FIG. 9, is assembled by first placing the rubber washer 170 into the cap, and then inserting the actuator, which in the embodiment shown includes the plunger 132 and the lip 166, into the cap against the washer 170. The blocking members 172 may then be attached to the cap to prevent the actuator from falling out of the cap. To complete the assembly, the cap 116 is screwed onto the handle 122, with the actuator becoming operably connected to the proximal end of the plunger 128.

To operate the device 100 of FIG. 8, the cap 116 is first removed from the handle 122 in order to fill the reservoir 124 through the opening 142. The cap is then placed back onto the handle 122. To dispense solution from the reservoir 124, the user presses on the plunger 132, thereby pushing the lip 166 toward the blocking members 172 and simultaneously pushing the rod 128 distally to move the sealing member 136 away from the orifice 134. As the lip 166 moves away from the cap 116, the rubber washer 170 unseals the opening 164 to release vacuum pressure from the reservoir. Solution exits the reservoir 124 from the orifice 134 by gravity feed, with the opening of the valves 164 providing for a greater flow of fluid through the orifice 134. In the embodiment shown, the blocking member 158 compresses the spring 156 which also providing metered flow out of the orifice. When the force on the plunger 132 is released, the spring forces the blocking member 158 and the rod 128 proximally to close the orifice 134.

This combination of components, particularly the exit orifice and the pressure release openings, advantageously enables a higher flow rate of fluid from the reservoir to the scrubbing surface area, thereby overcoming the problem in much of the prior art, which provide a flow rate that is too low for many household cleaning purposes, such as cleaning toilets.

It will be appreciated that any number of pressure release valves of varying size may be provided in the cap 116 to regulate any vacuum pressure which may be created within the reservoir 124 when the orifice 134 is opened to release solution. For example, when a large orifice is provided or when pressure enhancing members such as described above are provided, a certain amount of vacuum pressure with the reservoir 124 may be desirable to limit flow. In these designs, smaller or fewer pressure release valves are provided. Conversely, no vacuum pressure may be equally as desirable should flow be restricted adequately by a smaller orifice, and consequently this would require larger or a greater number of pressure release valves. It will be appreciated that the vacuum pressure release valves may be designed to be operated independently from the operation of the exit orifice sealing member, or they may be designed to open and close simultaneously.

It will also be appreciated that in either of the embodiments described above, the reservoir exit orifice 34 or 134 need not be a one-way valve, as minor amounts of liquid which may be sucked into the reservoir would be limited and immediately disinfected by the concentrated disinfectant solution in the reservoir. However, for sanitary, regulatory, or other reasons, a one-way anti-siphon valve system may be provided for cleaning devices which will be used in commercial settings such as hotels and hospitals to ensure that no exterior moisture can be sucked back into the reservoir. Therefore, another embodiment of this invention has a one-way valve for the orifice. Of course there are many other methods to open the outlet valve, all of which can be explored on a cost-benefit basis. Other types of valves, including needle valves, are also contemplated as being compatible with the embodiments as described. Furthermore, for either the exit valves or the pressure release valves of the preferred embodiments, any number of different sealing members may be used, including but not limited to, grommets, washers, O-rings, gaskets, etc.

It will also be appreciated that in the embodiments above, single or multiple orifices 34 or 134 may be provided around the base 18 or 118, respectively, as desired to provide an appropriate volume of solution. The single or multiple orifices preferably allow enough fluid to flow from the reservoir to treat the fixture required. For example, since toilet bowls hold between 0.5 and 4.0 gallons of water, a device designed as a toilet brush preferably contains enough cleaning or disinfecting solution dispensed in a reasonable amount of time to treat such an amount of water. Therefore, in one embodiment, the orifice or orifices 34 or 134 are preferably designed to ensure a fast enough flow rate, even if high viscosity bathroom cleaning solutions are used in the reservoir. These orifices in one embodiment preferably release solution at a rate of at least 1 milliliters per second to make the product acceptable for toilet bowl cleaning, and at least 0.2 milliliter per second for other bathroom and household fixtures. Several methods for increasing flow rate are envisioned including, but not limited to, increasing the size of the orifice, increasing the number of orifices, treating the walls of the orifice with flow enhancing materials such as Teflon, and increasing pressure inside the reservoir with vacuum pressure release valves such as described above. The orifice 34 or 134 described above may be any of a number of shapes including round, square, cone and elliptical.

Figure 17:
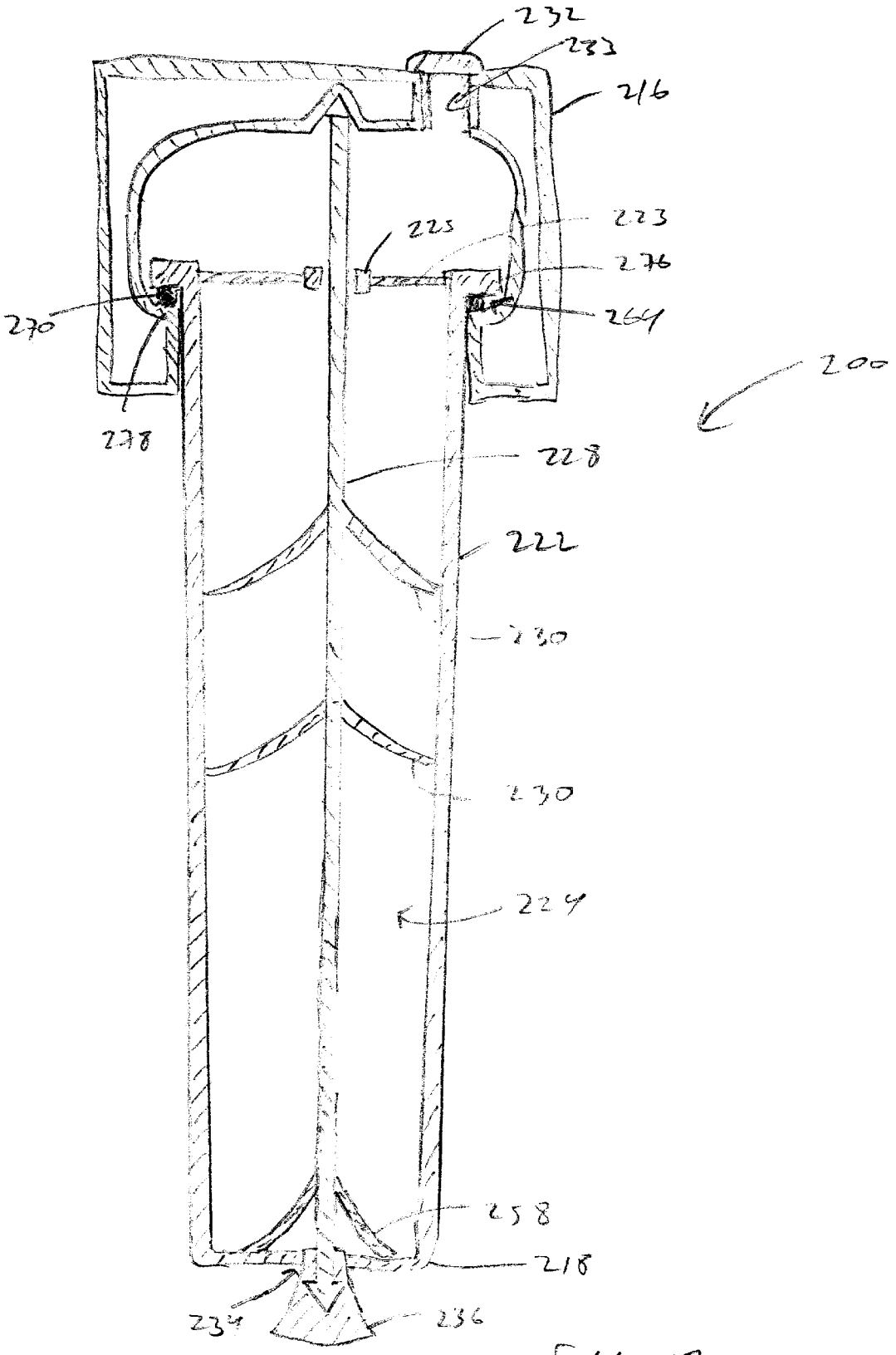
FIG. 17 is a cross-sectional view of another embodiment of a cleaning device according to the present invention.

FIG. 17 illustrates another embodiment of a cleaning device 200. In this embodiment, the entire cap 216 is moveable with respect to the handle 222 to open and close the sealing orifice 234. More particularly, as illustrated, the handle 222 in this embodiment is tapered to have a decreasing diameter toward the base 218 of the device, which is preferably integrally formed. The rod 228 extends within the reservoir 224 from the cap 216 to the sealing member 236. As shown, the distal end of the rod 228 may be formed with an arrowhead to securely connect to the conically shaped sealing member 236. A lid 232 is provided in the cap 216, which may be removably connected to expose a fill opening 233 through which solution is poured into the reservoir 224. The proximal end of the handle 222 preferably includes a plurality of spokes 223 which extend from the wall of the handle 222 and connect in a ring 225 which surrounds the rod 228 but is not connected thereto. This ring 225 provides a pathway through which the rod 228 moves, and also assists in centering the rod and preventing buckling. Solution delivered through the opening 233 passes from within the cap to the reservoir 224 within the handle between the spokes 223.

At the connection between the cap 216 and the handle 222, a pressure release valve 264 is provided. More particularly, the proximal end of the handle 222 preferably has a lip 276 extending beyond the outer diameter of the handle which abuts on its lower surface against a base portion 278 of the cap. On this base portion 278 an O-ring or other type of sealing member is attached. Thus, when the cap is located at its most proximal position away from the orifice 234, the O-ring 270 prevents any pressure from within the reservoir 224 from escaping. When the cap 216 is moved distally toward the orifice, the base portion 278 moves away from the lip 276, thereby breaking the seal and opening the pressure release valve 264.

The movement of the rod 228 proximally and distally is controlled by a leaf spring 258. More preferably, as described above with respect to spring 158 in FIG. 12B, this spring 258 is preferably fixed to the rod 228 and is in contact with the base 218 when the orifice 234 is closed. When the cap 216 is pressed distally to open the orifice 234, the flanges of the spring 258 flex against the base 218. Thus, once the force on the cap 216 is released, the force on the spring 258 is released and the rod is pushed proximally to return to its original position. FIG. 17 further illustrates that stabilizers 230 may also be provided with a similar configuration as the spring 258 to prevent buckling of rod 228. Moreover, when the handle 222 tapers in diameter, these stabilizers 230 may also assist in providing a spring force acting against the movement of the rod 228.

The embodiment described in FIG. 17 advantageously uses the motion of the entire cap to break the seal 270 to control pressure within the reservoir 224. Additionally, the force of moving the entire cap distally against the reservoir 224 provides additional pressure on the solution contained therein, which advantageously assists in releasing solution from the orifice 234.

It will be appreciated that standard manufacturing methods are preferably used to design and manufacture the cleaning device of the preferred embodiments described above. One preferred method is to use existing parts which are commonly mass produced, such as brush heads, in conjunction the handle or base described above. Commonly used methods for attaching the various parts of preferred cleaning devices will also be used for joining operations, such as snap or press fit, flaring, spiral or bayonet threading, and gluing. Most common methods to manufacture the major parts are extrusion, melting, injection molding, or machining.

Basic engineering principles will preferably be used to minimize costs while improving performance for desired applications. For example, the reservoir of the preferred embodiments is preferably sufficiently strong yet still holds enough solution for multiple uses before refill. This feature serves another purpose since a larger diameter tube uses less material than a narrow shaft for the same strength.

In terms of materials selection, each component of the cleaning device is preferably constructed of any material sturdy enough to withstand the demands of the task of a household or commercial brush, as required. An example of a demanding household task is cleaning a toilet bowl whereby the brush handle is commonly hit on the side of the toilet bowl to shake excess water from the bristles. Additionally, the materials are preferably resistant to cracking, leaking, or, if in contact with the cleaning or disinfectant solution which will be held by the reservoir, they must be resistant to such potentially caustic cleaning and disinfectant solutions (in water, alcohol, etc). Due to their low cost, versatility, and recognizability with related products, the preferred materials for this device are plastics. One preferred plastic is high density polyethylene because it offers cost efficiency and other desired attributes including translucency, which will allow users to clearly see the solution level within the reservoir without additional or extraneous measuring devices.

Varying colors or combination of materials may be used for aesthetic or ergonometric purposes. For example, dip molding or extruded rubber may be used for a non-slip handle. Rubbers/elastomers that are resistant to the above solutions may also be preferable for the grommet and sealing member, especially near the orifices of the reservoir.

Brush bristles are preferably made from polypropelyne, nylon, or polyester. Other plastics such as polycarbonate may be selected for specific parts such as the rod and other components of the plunger assembly unit.

As the designs of the preferred devices above preferably provide for an easily refillable reservoir, the handle has a fill opening that is preferably large enough and shaped to accept pouring of cleaning or disinfectant solution from commonly available household cleaning solution containers. The reservoir itself is preferably large enough to ensure a minimum of at least 10 uses per fill. All reasonable precautions are preferably taken in materials selection and overall design to guarantee no significant leakage from the reservoir over a long period of time. As an additional means to control any potential leakage, the device is envisioned to be used in conjunction with a container sized large enough to capture a full reservoir amount of leakage from the device. Such a container will not only serve as a leak control system, but can also protect against dust collection as well as being aesthetically pleasing.

In use, a disinfectant or cleansing solution will preferably be contained within the reservoir of the preferred embodiments. The types of solutions contained in the reservoir are not restrictive. Any commonly used or commercially available solutions, liquids, or gels can be chosen by the user. Although the preferred embodiments of this invention describe solutions that are disinfectant in nature, other embodiments include, but are not restricted to, cleansers, deodorants, fragrances, colors, abrasives, gelling agents, preservatives, bleaches, oils, and surface treatments, either used alone or in combination. Furthermore, because the design of the preferred embodiments is envisioned to be used in combination with liquids with a wide range of viscosities, the integral parts including, but not limited to, the fill opening, the reservoir, the orifice, and pressure release valves are preferably designed in coordination with each other to allow a single design to be compatible with liquids with viscosities of the range of standard household cleaning and disinfecting products. However, one design may be optimized for a particular viscosity within that range.

It is also contemplated that because the preferred devices of this invention will be containing significant volumes of liquid, a multi-purpose holder for the device may be desirable. Naturally, the holder could be an aesthetic addition to a bowl brush. More preferably, the holder could be a redundant backup liquid collection device should any liquid inadvertently leak or drip from the brush. Therefore the holder in one embodiment is preferably designed with enough liquid containing capacity for the full amount of liquid which the brush reservoir could hold.

Uses for the preferred embodiments of the present invention include, but are not limited to, toilet bowls, urinals, sinks, showers, tiling, counters, fabrics and any other appropriate surface. Most residential, commercial, and industrial settings can benefit from this device, but it may be most useful in residential homes, condominiums, apartments, hotels, hospitals, office buildings, manufacturing facilities or other industrial locations. Several of the many benefits of this invention are that it can reduce splash from separately applied liquid or gel containers, and when used on multiple fixtures (such as in hotel or hospital settings) it can reduce disease transmission between toilet bowls or urinals. Although it may be more costly, another embodiment is where the entire device be designed as a one-use disposable unit as there may be needs for such a device.

As this device will serve to encourage more sanitary cleaning by applying disinfectant with every use, it will also save overall soap and other chemical usage by reducing the amount used to only what is necessary for disinfecting and cleaning the bathroom fixtures.

While the above description contains many specifications, these should not be construed as limitations on the scope of the invention, but as merely providing illustrations of preferred embodiments thereof. Many other variations are possible. For example, the reservoir can have many shapes, such as oval, square, hexagonal, etc.; the scrubbing member can have other shapes or characteristics; the cap as shown can be replaced by other types of caps. It will also be appreciated that various other mechanisms may be used to open the exit orifice and/or the pressure release valves. For example, another embodiment contemplated has the handle attached to or operatively connected with the orifice sealing member. Then, as the base makes contact with the fixture to be cleaned, the handle slides relative to the base. This motion simultaneously pushes, pulls, slides or rotates the orifice sealing member to an open position, thereby allowing solution from the reservoir to exit the reservoir.

Therefore, the scope of the invention should not be determined by the embodiments illustrated, but by the appended claims and their legal equivalents.

What is claimed is:

1. A cleaning device, comprising:

a body having a proximal end and a distal end and a longitudinal axis extending at least partially therebetween, said body enclosing a reservoir capable of receiving and holding a liquid;

a cleaning surface provided adjacent said distal end of said body;

an outlet valve provided adjacent said distal end of said body adjacent said cleaning surface, said outlet valve capable of allowing the liquid to exit said reservoir at a rate of at least 0.2 milliliters per second; and a pressure release valve provided adjacent said proximal end of said body for regulating pressure within said reservoir;

wherein said cleaning surface includes a plurality of bristles adjacent said distal end, wherein at least some of said bristles extend away from said distal end of said body from a first end to a second end, said second end extending in a direction generally perpendicular to the longitudinal axis of the body.

2. The cleaning device of claim 1, wherein said outlet valve comprises a first opening in said body and a first sealing member moveable between a first position which seals against said first opening and a second position spaced apart from said first opening.

3. The cleaning device of claim 2, wherein said pressure release valve comprises a second opening in said body and a second sealing member moveable between a first position which seals against said second opening and a second position spaced apart from said second opening.

4. The cleaning device of claim 3, further comprising a rod extending through said reservoir, said rod having a proximal end operably connected to said second sealing member, and a distal end operably connected to said first sealing member, such that when said rod moves from a first position to a second position, said first and second sealing members simultaneously move from their respective first position to their second position to open both said outlet valve and said pressure release valve.

5. The cleaning device of claim 4, wherein said first sealing member is disc shaped having a diameter greater than that of the first opening.

6. The cleaning device of claim 4, wherein said first sealing member is disc shaped having a diameter greater than that of the first opening.

7. The cleaning device of claim 4, wherein said second sealing member includes a plunger that extends at least partially outside of said body, said plunger being moveable relative to said body to move said rod.

8. The cleaning device of claim 4, wherein said rod moves in a proximal to distal direction to open both said outlet valve and said pressure release valve.

9. The cleaning device of claim 1, wherein said body includes a handle having a first end and a second end, wherein at least said first end defines an opening for filling said reservoir with said liquid.

10. The cleaning device of claim 9, further comprising a cap being removably connected to said handle, said cap when connected at least partially enclosing said reservoir.

11. The cleaning device of claim 9, further comprising a base at said second end of said handle, said base at least partially enclosing said reservoir.

12. The cleaning device of Claim 11, wherein said outlet valve is provided in said base.

13. The cleaning device of claim 11, wherein said reservoir is at least partially contained in said base.

14. The cleaning device of claim 11, wherein said cleaning surface is attached to said base.

15. The cleaning device of claim 1, wherein the plurality of bristles extend in multiple directions away from opposite sides of said body.

16. A toilet brush, comprising:

a body enclosing a reservoir for receiving and holding a cleaning solution;

a cleaning surface provided adjacent one end of said body, said cleaning surface being sized and configured to clean an interior of a toilet bowl;

an outlet valve provided adjacent said one end of said body adjacent said cleaning surface, said outlet valve capable of allowing the cleaning solution to exit said reservoir at a rate of at least 1 milliliter per second; and a pressure release valve provided adjacent another end of said body for regulating pressure within said reservoir.

17. The toilet brush of claim 16, wherein said outlet valve comprises a first opening in said body and a first sealing member moveable between a first position which seals against said first opening and a second position spaced apart from said first opening.

18. The toilet brush of claim 17, wherein said pressure release valve comprises a second opening in said body and a second sealing member moveable between a first position which seals against said second opening and a second position spaced apart from said second opening.

19. The toilet brush of claim 18, further comprising a rod extending through said reservoir, said rod having a proximal end operably connected to said second sealing member, and a distal end operably connected to said first sealing member, such that when said rod moves from a first position to a second position, said first and second sealing members simultaneously move from their respective first position to their second position to open both said outlet valve and said pressure release valve.

20. The toilet brush of claim 18, wherein said second sealing member includes a plunger that extends at least partially outside of said body, said plunger being moveable relative to said body to move said rod.

21. The toilet brush of claim 16, wherein said body includes a handle having a first end and a second end, wherein at least said first end defines an opening for filling said reservoir with said cleaning solution.

22. The toilet brush of claim 16, wherein said cleaning surface includes a plurality of bristles.

23. The toilet brush of claim 22, wherein at least a portion of the plurality of bristles is attached to the body at a location above the valve.

24. The toilet brush of claim 22, wherein the plurality of bristles surrounds the outlet valve.

25. The toilet brush of claim 22, wherein at least some a of the bristles extend away from an end of said body in a direction generally perpendicular to a longitudinal axis of said body.

26. The toilet brush of claim 22, wherein the plurality of bristles extend in multiple directions away from opposite sides of said body.

27. The toilet brush of claim 16, further comprising a cleaning solution said reservoir.

28. The toilet brush of claim 16, wherein said cleaning solution is a disinfecting solution.

* * * * *